US007109946B2

(12) United States Patent
Piole

(10) Patent No.: US 7,109,946 B2
(45) Date of Patent: Sep. 19, 2006

(54) HECTOMETRIC WAVE TRANSMISSION ANTENNA

(75) Inventor: Philippe Piole, Cesson-Sevigne (FR)

(73) Assignee: Telediffusion de France SA, Paris (FR)

( * ) Notice: Subject to any disclaimer, the term of this patent is extended or adjusted under 35 U.S.C. 154(b) by 114 days.

(21) Appl. No.: 10/520,528

(22) PCT Filed: Jun. 16, 2003

(86) PCT No.: PCT/FR03/01822

§ 371 (c)(1),
(2), (4) Date: Jan. 7, 2005

(87) PCT Pub. No.: WO2004/008572

PCT Pub. Date: Jan. 22, 2004

(65) Prior Publication Data

US 2005/0253771 A1 Nov. 17, 2005

(30) Foreign Application Priority Data

Jul. 8, 2002 (FR) ..... 02 08642

(51) Int. Cl.
*H01Q 9/34* (2006.01)

(52) U.S. Cl. ..... 343/874; 343/886

(58) Field of Classification Search ..... 343/874, 343/886, 887, 890

See application file for complete search history.

(56) References Cited

U.S. PATENT DOCUMENTS

| | | | | |
|---|---|---|---|---|
| 2,171,256 | A | 8/1939 | Balliol | |
| 2,998,604 | A | 8/1961 | Seeley | |
| 4,001,832 | A * | 1/1977 | Chesneau et al. | 343/747 |
| 4,001,833 | A * | 1/1977 | Chesneau et al. | 343/747 |

OTHER PUBLICATIONS

Cho et al; "Space Diversityt Antenna Arrangements Mounted On A Metal Pole For Illuminating A Street Cell"; IEEE Transaction on Vehicular Technology, IEEE Inc., New York UD, vol. 47, No. 2; May 1998, pp. 531-536, XP000870838.

* cited by examiner

*Primary Examiner*—Tho Phan
(74) *Attorney, Agent, or Firm*—Lowe Hauptman & Berner

(57) ABSTRACT

To avoid searching for a new location for very high hectometric wave antennas, an antenna according to the invention comprises an existing vertical structure having a height of at least approximately ten meters and including at least one electrically conductive element connected to the ground, and an excitation conductor wire (4*a*) that is essentially electrically conductive, disposed at least in part in the vicinity of and outside the structure and connected to a emitter (E) so that the structure radiates substantially hectometric waves. The existing structure may be a broadcasting tower, a water tower, a chimney, a lighthouse or a lamp standard, wherein the excitation wire merges visually. The wire can be replaced by a conductive loop a few meters long, magnetically coupled to the structure.

23 Claims, 6 Drawing Sheets

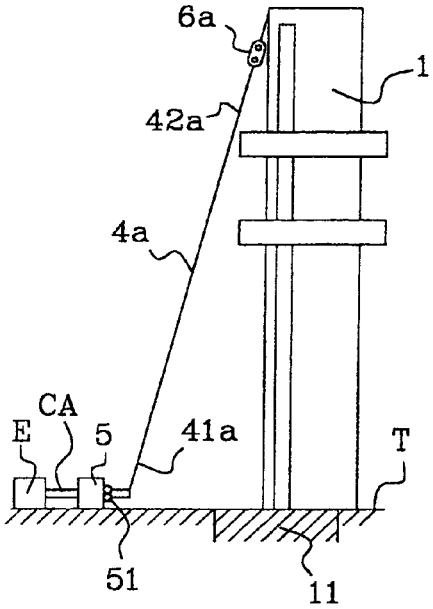
Fig. 17
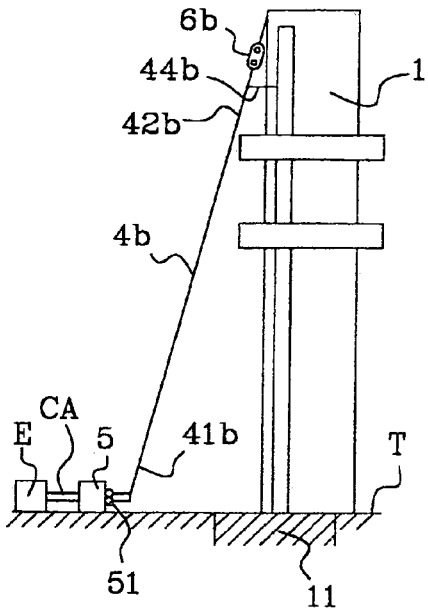
Fig. 18
Fig. 19
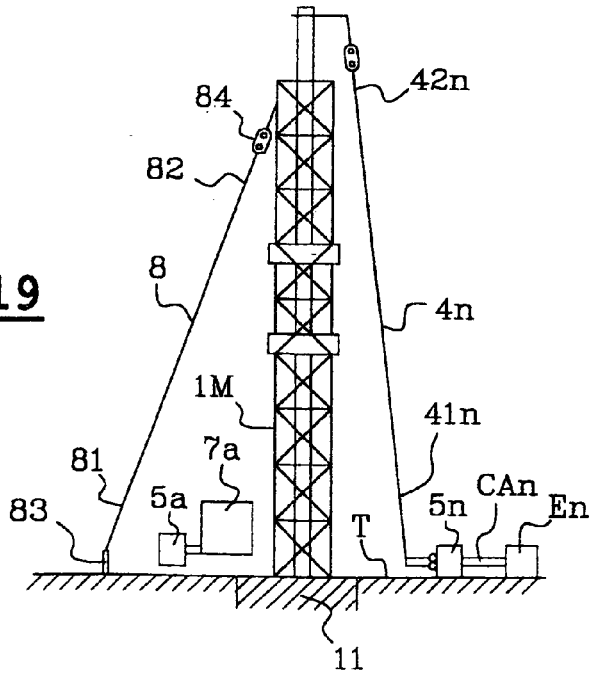

HECTOMETRIC WAVE TRANSMISSION ANTENNA

CROSS-REFERENCE TO RELATED APPLICATIONS

This is a U.S. National Phase and claims the benefit of the filing date of PCT/FR2003/001822, filed Jun. 16, 2003, and also claims the benefit of priority under 35 U.S.C. §119 of French Application No. 02/08642, filed Aug. 8, 2002, the entire disclosures of which are hereby herein incorporated by reference.

FIELD OF THE INVENTION

The present invention relates to an antenna for emitting hectometric waves in particular, i.e. in a medium waveband from approximately 300 kHz to approximately 3 MHz. It relates more particularly to a radio broadcasting antenna for broadcasting radio programs in the medium waveband from 500 kHz to 1600 kHz in the context of developing the Digital Radio Mondiale (DRM) standards for worldwide digital broadcasting.

BACKGROUND ART

At present, to emit signals in the hectometric waveband, isolated radiating masts of very great height, of the order of 20 to 200 meters, are generally installed far away from towns and broadcast relatively high powers. If it is required to install a mast of this kind near a built-up area or in a town, a large area must be available, for safety reasons in particular, for erecting the radiating mast and installing the ground network associated with the mast and comprising a plurality of wires placed on the ground or buried at a shallow depth in the ground. Consequently, to install a mast type antenna, it is necessary to obtain land for it, the necessary government permits, and the approval of immediate neighbors.

Moreover, a mast type antenna is not able to multiplex a plurality of emission signals with different frequencies at high power; for example, it is not possible to multiplex emission signals with high power differences, for example one at 300 kW and another at 1 kW.

OBJECT OF THE INVENTION

An object of the invention is to solve the problems of prior art hectometric wave antennas in such a manner as to avoid searching for a new location for this kind of antenna and to propose solutions that are more economical and more discreet in the countryside, in particular on the fringes of built-up areas.

SUMMARY OF THE INVENTION

To obtain this object, an antenna for emitting substantially hectometric waves, characterized in that it comprises an existing vertical structure having a height of at least approximately ten meters and including at least one electrically conductive member connected to the ground, and electromagnetic excitation wire means that is essentially electrically conductive, disposed at least in part in the vicinity of and outside the structure and connected to an emitter so that the structure radiates substantially hectometric waves.

Thus the invention utilizes existing vertical structures, in particular reinforced concrete or metal structures, such as radio broadcast antenna towers, lighthouses, chimneys, water towers or lighting masts, which are very often found near towns, to install high antennas according to the invention. There is no necessity to search for available land and the additional excitation wire means is discreet and merges visually with the existing structure.

The principal radiating element of the antenna of the invention consists of the existing structure, which radiates efficiently over a wide band of frequencies of a few tens of kilohertz day and night in a coverage area on the ground from approximately 3 km to approximately 15 km.

In a first embodiment, the excitation means is electrically coupled to the structure and comprises a conductive excitation wire substantially extending at least partly outside and along the structure. The conductive wire has a first end connected to the emitter through impedance matching means situated substantially in front of the base of the structure and a second end fixed to the structure.

In a second embodiment, the excitation means is magnetically coupled to the structure and comprises a conductive loop situated above the ground outside and near the structure.

The above two embodiments may be combined. The electromagnetic excitation means then comprises a plurality of conductive excitation wires embodying to the invention for different frequency bands and/or a plurality of conductive loops embodying to the invention for different frequency bands.

BRIEF DESCRIPTION OF THE DRAWINGS

Other features and advantages of the present invention will become more clearly apparent on reading the following description of preferred embodiments of the invention, given with reference to the corresponding appended drawings, in which:

FIGS. 17 to 22 are diagrammatic vertical views of antennas according to the invention making at least partial use of portions of diverse existing vertical structures.

DETAILED DESCRIPTION OF THE DRAWINGS

Figure 1:
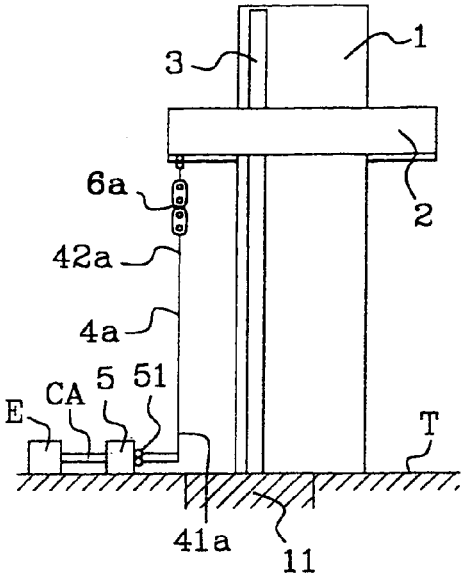
FIG. 1 is a diagrammatic vertical view of a first embodiment of a emission antenna of the invention with a conductive excitation wire for electrical coupling.

The following description refers to an existing National Network Video Broadcasting tower (NNVD) adapted to support diverse emit and receive antennas, in particular antennas for television signals and other telecommunication signals, in particular for communications with mobile terminals, by way of an existing vertical structure having a height of at least some ten meters. For example, as shown in FIG. 1, the tower 1 is a reinforced concrete tower with a height that is generally from approximately 10 m to more than approximately 100 m and that may comprise an intermediate platform 2 for supporting diverse emit and/or receive antennas.

The tower 1 comprises one or more electrically conductive members that are electrically connected to ground T and which are diagrammatically represented by a metal column 3 extending vertically from the ground inside the tower 1. In practice the electrical ground is an array or mesh of conductive wires 11 buried under or near the tower 1. For example, the metal column 3 is a diagrammatic representation of a metal staircase providing access from the ground T to the platform 2, and/or one or more metal water pipes or jackets, or one or more metal frames and ironwork generally embedded in the concrete of the walls of the tower.

The emit antenna is typically adapted to emit signals at a frequency of the order of 1.5 MHz and at a power of 5 kW that are supplied by a emitter E connected to an antenna by a coaxial feeder cable CA, for example.

In a first embodiment, the metal members of the tower 1 radiate in response to electromagnetic excitation by virtue of being coupled to or electrically continuous with excitation wire means of the conductive wire type at least substantially half of which is disposed on the outside of and runs along a vertical portion of the existing structure consisting of the tower 1.

The first embodiment encompasses a first group of variants suited to relatively high towers, the height of which is substantially equal to at least $\lambda/4$, i.e. a height at least of the order of 50 m for a emission frequency of 1.5 MHz, and a second group of variants suited to relatively low towers, the height of which is substantially from $\lambda/8$ =25 m to $\lambda/4$=50 m.

In a first variant of the first embodiment shown in FIG. 1, the antenna comprises a straight thin conductive excitation wire 4*a* having a diameter of approximately 10 mm, for example, and a length substantially equal to $\lambda/4$, and extending vertically in the vicinity of the tower 1, for example at a distance from the tower of approximately 1 m to approximately 5 m. The wire 4*a* is tensioned between a first end 41*a* connected to the output 51*d* of an impedance matching cell 5 disposed on the ground T substantially in front of the base of the tower 1 and a second end 42*a* far above the ground and fixed to the platform 2 of the tower 1 by means of an electrical insulator 6*a*. For example, the matching cell 5, also referred to as a matching cabin, comprises, at the output of a power amplifier connected by the coaxial cable CA to the emitter E, variable inductive and capacitive matching components connected in series and in parallel for substantially converting the complex impedance of the antenna to the resistive characteristic impedance of the coaxial cable, which is typically equal to 50 Ω. For example, the cell comprises two capacitors in series between the power amplifier, when present, or the internal conductor of the cable CA, and the first end 41*a* of the excitation wire 4*a*, together with an inductor grounding a terminal common to the capacitors. Thus the matching cell constitutes a transformer, preferably of variable impedance, to which safety circuits may be added to prevent overheating of the matching components as a function of the emitted power. The insulator 6*a* comprises an insulative synthetic material wire tensioned between the second end 42*a* of the conductive excitation wire and the platform 2, for example.

In FIG. 1, the excitation wire 4*a* of length $\lambda/4$ serves as close coupling means with the tower to excite the conductive member 3 in the tower 1 that constitutes the main radiating element. The impedance of the antenna is relatively low and depends on the ratio of the dimensions of the wire 4*a* and the tower 1, in particular their diameters and lengths.

When the antenna is operating, the inductor current in the excitation wire 4*a* and the induced currents in the tower 1 balance each other, and a portion of the induced currents is also distributed in the upper portion of the tower above the wire 4*a*. Thus the invention utilizes all of the infrastructure of the tower to radiate signals emitted by the emitter E. The wider the tower, the greater the bandwidth of the antenna, which advantageously reduces the reactance of the antenna and increases the radiating resistance of the antenna.

Thus in the variants described hereinabove the main radiating element is the tower and the bottom portion of the tower is not insulated but grounded. The low portion of the tower has a very low impedance and thus a high current region equivalent to a current peak. The conductive wire 4*a* at a distance from approximately 1 m to approximately 5 m from the tower excites the tower in quarter-wave mode, yielding a complex impedance that may be matched in the matching cell 5. If the electrical ground provided by the tower is implemented correctly, the apparent power of the antenna is substantially equal to the power of the emitter E. A ground network 11 is preferably added to the existing network and improves the efficiency of the antenna, typically consisting of about ten conductive metal wires or strips disposed in a star arrangement and each having a length of $\lambda/4$. The ground network may be installed under and connected to the matching cell 5.

To allow a relatively high emission power and to reduce electrical losses, the conductive wire 4*a* is replaced by a conductive tube or by a cage made up of a plurality of parallel conductive wires; this achieves emit powers of 5 kW and guarantees a relatively wide bandwidth.

Two other variants of the first embodiment, shown in FIGS. 2 and 3, again relate to electrically conductive wire type excitation means with an impedance matching cell 5.

Figure 2:
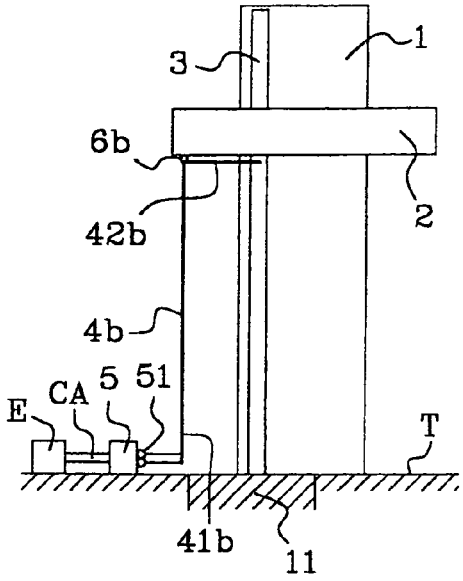
FIG. 2 is analogous to FIG. 1 and relates to a variant of the first embodiment that is of the folded dipole type.

In FIG. 2, the conductive excitation wire 4*b* again has its bottom end 41*b* connected to the impedance matching cell 5, but its top end 42*b* is connected to the conductive member 3 of the tower 1. For example, the conductive wire 4*b* with a length of approximately $\lambda/4$ extends mainly vertically in the vicinity of the tower 1 under the platform 2, being suspended under the platform by means of an insulator 6*b*, and is then bent under the platform and closed under the conductor 3 by means of the end 42*b*, which is welded to the conductive member 3 of the tower. If the conductive excitation wire 4*a* has a length substantially equal to λ/4 and the length of the conductive member 3 in the tower 1 between the ground T and the welded connection at the end of the wire 42*b* is substantially equal to λ/4, the antenna is of the half-wave folded dipole type and offers a higher impedance to ground. This galvanically grounds the antenna overall, including the excitation wire 4*b*.

Figure 3:
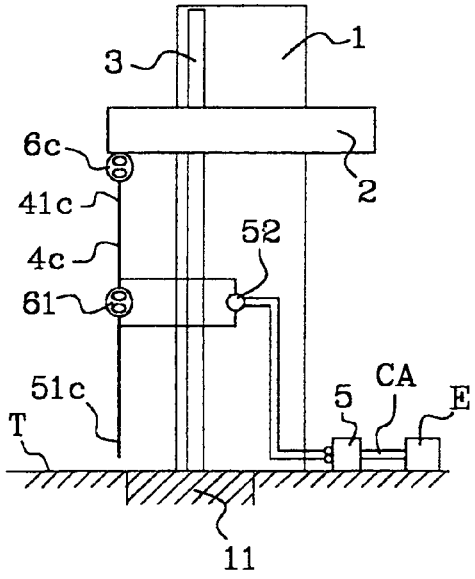
FIG. 3 is a diagrammatic vertical view of a symmetrical doublet type variant of the first embodiment of an antenna.

In the variant shown in FIG. 3, the excitation wire has a symmetrical doublet structure and consists of two conductive excitation wires 4*c* aligned vertically along the tower 1 and each having a length substantially equal to λ/4. The tower is very high in this case, more than approximately 100 m. The near ends of the two conductive wires 4*c* are connected by an insulator 61 and are fed by the emitter via the matching cell 5 and a power balancer 52 which divides the power of the emission signal equally between the two conductive wires 4*c*. The top end 41*c* of the top conductive wire 4*c* is suspended under the platform 2 of the tower 1 by an insulator 6*c* and the bottom end 51*c* of the bottom conductive wire 4*c* is situated above the ground T and may likewise be connected to the ground by an insulator. This symmetrical feed half-wave doublet type third variant of the antenna has a higher gain and a lower dependence with respect to ground, since a current peak is present at the center of the tower, at the level of the central insulator 61.

Figure 4:
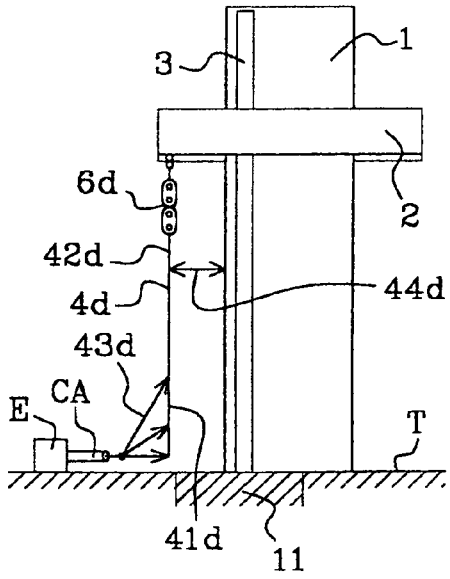
FIG. 4 shows another variant of the first embodiment with no impedance matching cell but with movable conductors at the ends of the conductive excitation wire.
Figure 5:
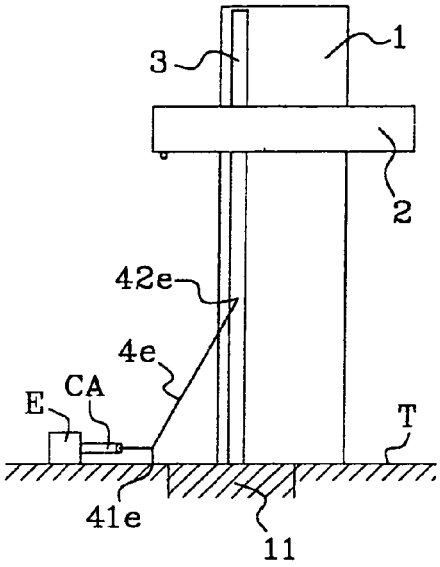
FIG. 5 shows a further variant of the first embodiment with no impedance matching cell and with a J-shaped configuration of the excitation wire.

Two other variants of the first embodiment of the invention are shown in FIGS. 4 and 5 and differ from the first three variants in the absence of the impedance matching cell 5, which makes them more economical. The portions of the matching means consisting of the matching cell are replaced by a movable conductor in the upper portion of the excitation wire and/or a conductor of variable length in the lower portion of the excitation wire.

As in the first variant shown in FIG. 1, the FIG. 4 antenna comprises a conductive excitation wire 4*d* that is stretched substantially vertically along the tower 1 between an insulator 6*d* suspended under the platform 2 and the vicinity of the ground T. The impedance of the antenna is matched to the impedance of the coaxial feeder cable CA connected to the emitter E by adjustable matching means at the ends of the conductive excitation wire 4*d*. The upper end 42*d* of the excitation wire 4*d* is connected to the tower 1 via a conductive wire 44*d* forming a short circuit that extends substantially perpendicular to the tower and slides through the intermediary of a metal cursor on the wire 4*d* along the tower 1 and/or the lower end 41*d* of the excitation wire 4*d* is connected to the emitter via a telescopic conductor 43*d*, one end of which, near the ground T, is fixed and connected to the internal conductor of the coaxial feeder cable CA and whose other end slides along the wire 4*d*. Three positions of the conductor 43*d* are represented diagrammatically in FIG. 4. The conductor 44*d* movable along the upper portion of the excitation wire and the adjustment of the height with respect to the ground of the active portion of the excitation wire 4*d* by the conductor 43*d* minimize the reactance of the antenna to change the impedance of the antenna to a resistive value substantially equal to the 50 Ω characteristic impedance of the feeder cable CA.

The fifth variant of the first embodiment shown in FIG. 5 relates to an antenna with a J-shaped feed and in which the lower end 41*e* and the upper end 42*e* of the excitation wire 4*e* are respectively connected to the internal conductor of the coaxial cable CA situated at the level of the ground T and to the internal conductive member 3 inside the tower 1. The excitation wire 4*e* extends obliquely to the vertical axis of the tower. The benefit of this variant is the ability to adjust the height of the point 42*e* of connection of the excitation wire 4*e* to the conductive member 3 inside the tower in order to match the impedance of the resulting antenna to the characteristic impedance of the feeder cable CA. The height of the end 42*e*, the inclination of the conductive wire 4*e* and the distance from the point 41*e* of attachment of the wire 4*e* relative to the ground T and to the tower 1 contribute to the impedance matching effect.

Thanks to the elimination of the impedance matching cell 5, the cost of the two variants shown in FIGS. 4 and 5 is lower than that of the three variants shown in FIGS. 1, 2 and 3.

Figure 6:
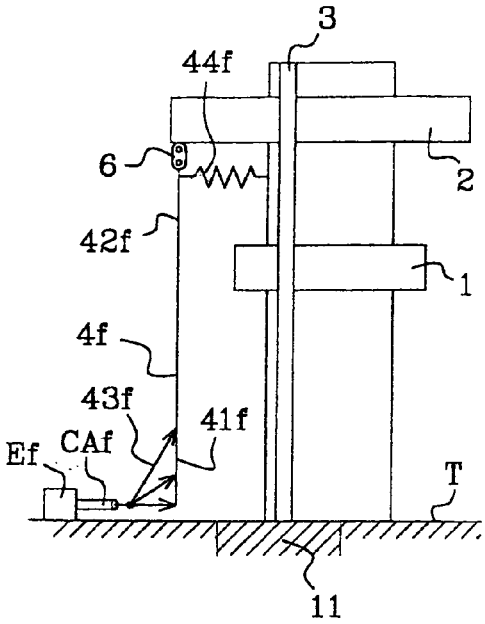
FIG. 6 shows a variant of the first embodiment with a terminal load for the conductive excitation wire.

The antenna shown in FIG. 6 is a combination of those shown in FIGS. 2 and 4. It comprises a conductive excitation wire 4*f* extending substantially parallel to the tower 1. The upper end 42*f* of the wire 4*f* is not connected directly to the conductive member 3 of the tower 1, but is instead connected to the conductive member 3 via a load 44*f*. The lower end 41*f* of the excitation wire 4*f* is connected to the internal conductor of the coaxial feeder cable CAf via a conductor 44*f* which is analogous to the conductor 43*d* shown in FIG. 4 and which is of variable length for adjusting the active height of the excitation wire 4*f* relative to the ground T. The load 44*f* may be a lossy terminating capacitor, but is preferably the characteristic impedance of the coaxial feeder cable CAf, so that the conductive member 4*f* is the seat of a traveling wave. These features allow the frequency to evolve without recourse to a matching cell and allow an antenna of this kind to be installed on low towers (height less than λ/4) whilst enlarging the bandwidth.

The antennas according to the first embodiment of the invention described above are single-frequency antennas, i.e. have a length of the conductive excitation wire substantially equal to λ/4, where λ is the wavelength corresponding to the center frequency of the band in which the antenna emits signals.

However, an antenna according to the invention may radiate signals in two or more frequency bands. Thus a plurality of excitation wire means 4*a*, 4*b*, 4*c*, 4*d*, 4*e*, 4*f* of the same type or different types are disposed around the tower 1 to emit signals in respective different frequency bands. Each excitation wire is associated with feeder means comprising a respective emitter and a respective coaxial cable, where applicable with a respective matching cell. This kind of disposition of the coupled excitation means allows excitation means to be added or removed independently of the other excitation means and thus multiplexing of emissions in different frequency bands as required.

Figure 7:
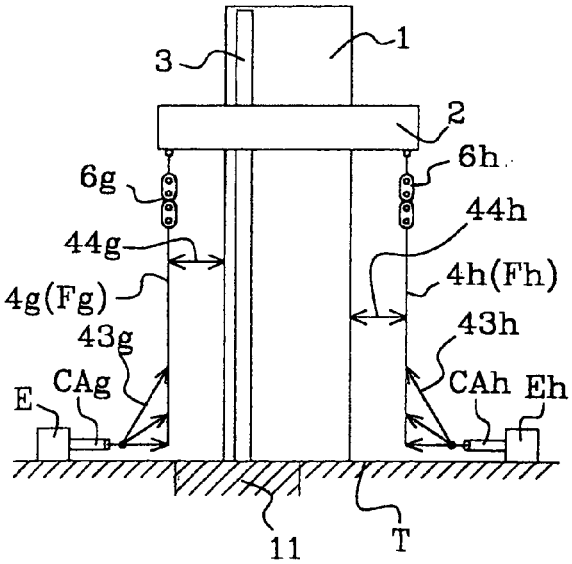
FIG. 7 is a vertical diagrammatic view of a dual frequency antenna with two conductive excitation wires of the type shown in FIG. 4.

For example, as shown in FIG. 7, a dual frequency antenna comprises two conductive excitation wires 4*g* and 4*h* that are diametrically opposed with respect to the tower 1 and analogous to the excitation wires 4*d* shown in FIG. 4. Each wire 4*g*, 4*h* has an upper end suspended by an insulator 6*g*, 6*h* under the platform 2 of the tower 1 and terminated by a short-circuit wire 44*g* able to slide vertically and in contact with the tower 1 and a lower end terminated by a conductor 43*g*, 43*h* of variable length connected to the internal conductor of a feeder cable CAg, CAh.

Figure 8:
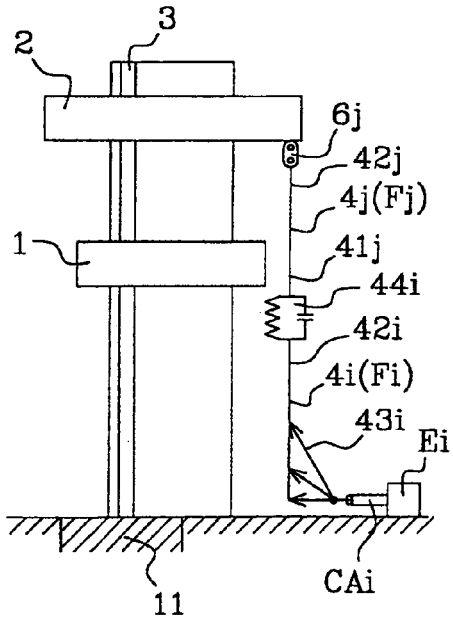
FIG. 8 is a diagrammatic vertical view of a dual frequency antenna with a conductive excitation wire with a blocking circuit constituting another variant of the first embodiment.

In another variant of a dual frequency antenna, the excitation means comprises a single wire, as in FIGS. 1 to 6, and two wires 4*i* and 4*j*, as shown in FIG. 8, that are suspended between the platform 2 of the tower 1 by way of an insulator 6*j* and the ground T by a conductor 43*i* of variable length and which are disposed vertically in line with each other. The upper end 42*i* of the lower wire 4*i* and the lower end 41*j* of the upper wire 4*j* are separated by a band-pass filter of the blocking circuit type that traps the excitation frequency Fi of the lower wire 4*i* and passes the excitation frequency Fj of the upper wire 4*j*.

In the embodiment illustrated in FIG. 8, the lower end of the lower wire 4*i* is connected, in a manner analogous to that of the wire 4*d* shown in FIG. 4, to a variable length conductor 43*i* in turn connected directly to the feeder cable CAi to match the impedance of the dual frequency antenna to the characteristic impedance of the feeder cable. The upper end 42*j* of the upper wire 4*j* is suspended under the platform 2 by an insulator 6*j*, like the excitation wire 4*a* in FIG. 1. The lengths of the excitation wires 4*i* and 4*j* are substantially equal to λi/4 and λj/4, corresponding to respective emission frequencies Fi and Fj. This variant is rather more intended for a tower 1 having a relatively great height, of at least about 100 m.

Figure 9:
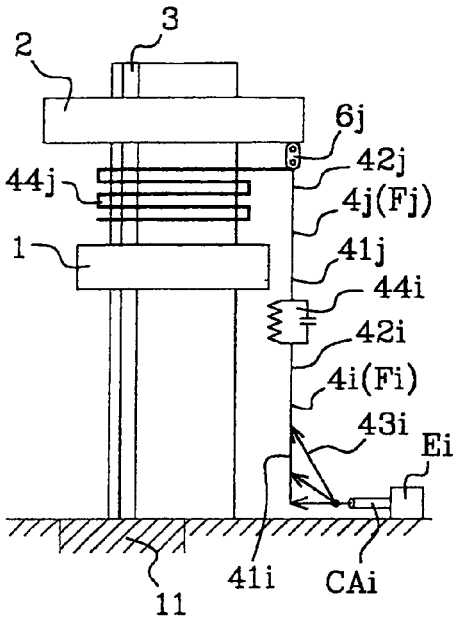
FIG. 9 is analogous to FIG. 8 but with capacitive termination of the dual frequency conductive excitation wire.

In another variant shown in FIG. 9 of the type shown in FIG. 8, the upper conductor wire 4*j* is of the same type as the wire 4*f* shown in FIG. 6, i.e. having a second end connected to a terminating capacitive load 44*j*. The capacitive load 44*j* consists of a few turns of conductive wire around the tower 1 and fixed against it, having one end connected to the upper end 42*j* of the excitation wire 4*j*. This variant is rather more intended for a tower 1 of medium height of the order of 50 m for at least one of the excitation members 4*i* or 4*j* with a length corresponding to λi/8 or λj/8. In this variant, the total wire 4*i*-4*j* has as a lower end 41*i* that is a current peak for the excitation frequency Fi of the lower excitation wire 4*i* and is the seat of a traveling wave for the excitation frequency Fj of the upper excitation wire 4*j*.

Figure 10:
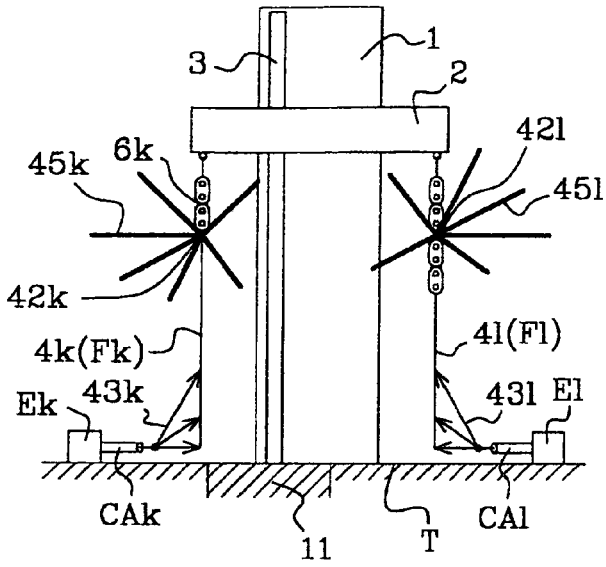
FIG. 10 is a diagrammatic vertical view of a dual frequency antenna with deployed conductive wires forming two terminating capacitors at the top ends of two conductive excitation wires.
Figure 11:
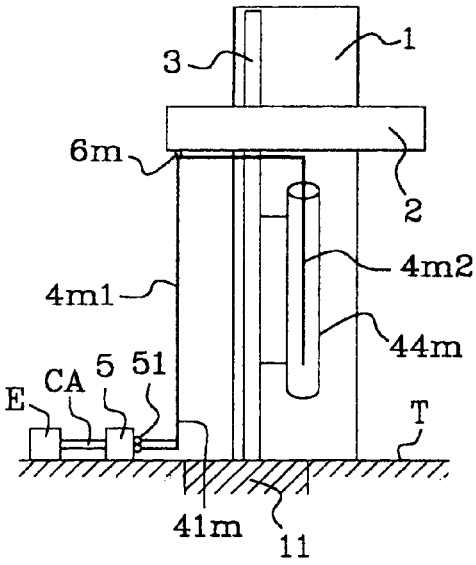
FIGS. 11 and 12 show other antennas according to the first embodiment with a coaxial terminating capacitor inside the structure.
Figure 12:
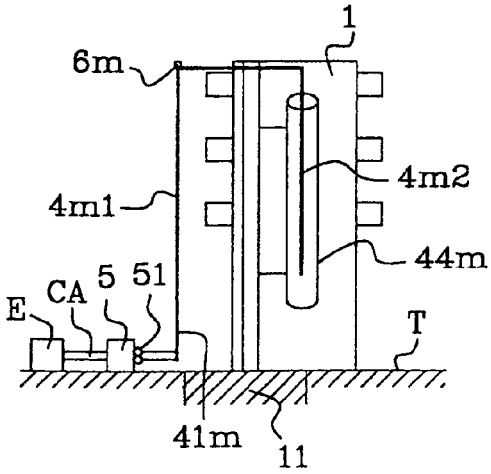

FIGS. 10, 11 and 12 show variants of the first embodiment using conductive excitation wire for low towers, for example from λ/8 to λ/4.

In FIG. 10, the antenna of the invention comprises two conductive excitation wires 4*k* and 4*l* whose lower ends are adjustable with respect to the ground by way of conductors 43*k* and 43*l* of variable length, as in the dual frequency antenna shown in FIG. 7. However, in the FIG. 10 variant, the tower is much smaller than that shown in FIG. 7 and the conductive wires 4*k* and 4*l* extend substantially vertically along the tower over distances substantially equal to λk/8 and λl/8 respectively corresponding to emission frequencies Fk and Fl produced by respective emitters Ek and El. To compensate the insufficient electrical height of the tower 1, the upper end 42*k*, 42*l* of the excitation wire 4*k*, 4*l* is fixed by a respective insulator 6*k*, 6*l* to the platform 2 of the tower and supports one or preferably several respective aerial conductor wires 45*k*, 45*l* each having a length equal to λk/8, λl/8. The wires 45*k*, 45*l* are deployed in a star-shaped arrangement substantially in a horizontal plane and/or obliquely relative to the tower and provide a terminating capacitance of the excitation wire 4*k*, 4*l* that increases in a virtual manner the electrical length of the excitation wire. The contribution of the conductive excitation wire 4*k*, 4*l* to the radiated electromagnetic field is greater because the shorter tower is less efficient.

The terminating capacitance consisting of each set of deployed conductive wires 45*k*, 45*l* may be replaced by a capacitor of the type wound around the tower, like that 44*j* shown in FIG. 9.

In another variant, shown in FIG. 11, the terminating load is replaced by a coaxial section inside the tower. The antenna has a bent first conductive excitation wire portion 4*m*1, analogous to the wire 4*b* shown in FIG. 2, extending on the outside of the tower 1 substantially vertically along it and suspended by an insulator 6*m*, and a second conductive excitation wire portion 4*m*2 extending substantially vertically in a conductive sheath 44*m*. The sheath 44*m* is fixed in the tower 1 and connected to the ground T via the conductive member 3. The portion 4*m*2 and the sheath 44*m* constitute a coaxial termination. The lengths of the first and second conductive excitation wire portions 4*m*2 are substantially equal to λ/8. For example, the lower end 41*m* of the first portion of the conductive excitation wire 4*m*1 is connected to an impedance matching cell 5. Thus the active portion 4*m*1 is virtually extended by the non-radiating coaxial extension 4*m*2-44*m* constituting a coaxial terminating capacitor whose function is similar to that of a set of deployed wires 45*k*, 45*l* or wound turns 44*j*. If the height of the tower 1 is not sufficient, the coaxial termination 4*m*2-44*m* may be wound, for example helicoidally, inside the tower, instead of extending in a straight line. For a relatively low tower, the upper end common to the conductive excitation wire portions 4*m*1 and 4*m*2 may be at the top of the tower, as shown in FIG. 12, so that the tower has a height substantially equal to λ/8.

Figure 13:
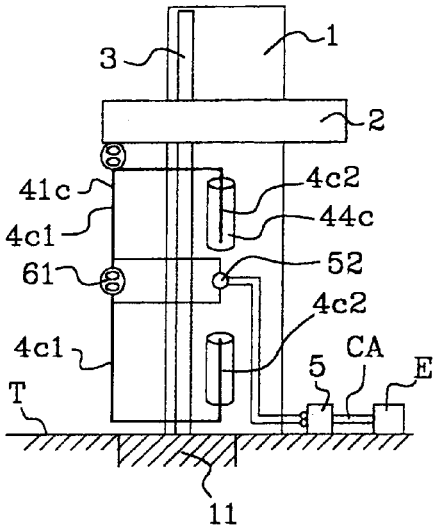
FIG. 13 shows a symmetrical doublet antenna like that shown in FIG. 3, but with two coaxial terminating capacitors.

The virtual lengthening of a conductive excitation wire in the variants shown in FIGS. 10 to 12 may equally be applied to each of the conductive excitation wires 4*c* of the doublet antenna shown in FIG. 3. As shown in FIG. 13, each conductive excitation wire of the doublet comprises an external first portion 4*c*1 and a second portion 4*c*2 inside the tower 1 in a conductive sheath 44*c*. The portions 4*c*1 and 4*c*2 each also have a length substantially equal to λ/8.

Figure 14:
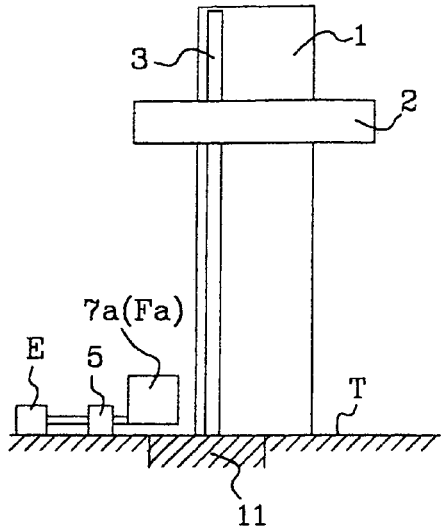
FIG. 14 is a diagrammatic vertical view of an antenna constituting a second embodiment of the invention and having a conductive excitation loop for magnetic coupling.

In a second embodiment of the antenna of the invention, electromagnetic excitation wire means employing magnetic coupling comprises a conductive excitation loop 7*a* situated inside and near the tower 1 and above the ground T, as shown in FIG. 14.

The excitation loop 7*a* is, for example, situated substantially at the level of the base of the tower 1 and consists of a square frame of a thin conductive wire, a conductive tube or a cylindrical cage of parallel conductive wires. The frame has a perimeter of several meters. Two vertical sides of the loop 7*a* are substantially parallel to the tower 1 and typically have a length from approximately 2 m to approximately 3 m. The loop 7*a* extends in a substantially vertical plane, diametral to the tower, at an isolating distance from the ground T of 1 to 2 m. Ends of the loop 7*a* situated at a peak close to the ground T, for example, and away from the tower 1 are connected to a emitter E via an impedance matching cell 5 and a coaxial cable feeder CA. The side closest to the tower is at a few tens of centimeters therefrom in order to couple the loop and the tower magnetically.

For a low tower with a height substantially from λ/8 to λ/4, the excitation loop 7*a* is situated substantially at a current peak in order to excite the conductive member 3 in the tower so that it radiates at the tuned frequency F of the loop 7*a* corresponding to the wavelength λ.

Instead of the impedance matching cell 5 and the excitation loop 7*a* being fixed to the ground, they may be removable and installed in a news van, for example, which may emit radio signals via the tower 1 when it is stopped close to the tower.

Figure 15:
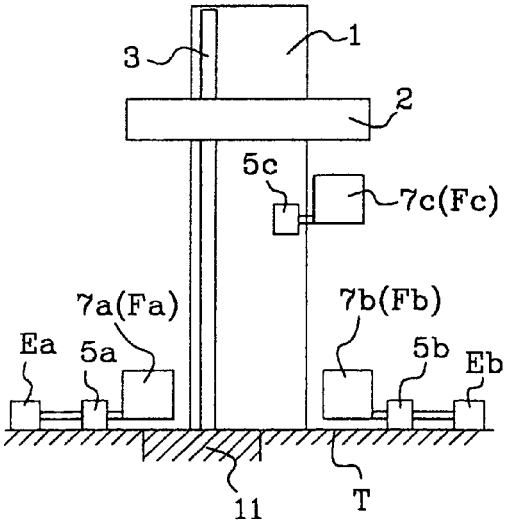
FIG. 15 shows an antenna according to the second embodiment radiating at three frequencies.

As shown in FIG. 15, a plurality of loops 7*a*, 7*b* and 7*c* having different dimensions and tuned to respective different frequencies Fa, Fb and Fc are magnetically coupled to the tower 1 to radiate signals in three different frequency bands. For example, the loops 7*a* and 7*b* are near the base of the tower 1 to emit signals whose wavelengths λa and λb are respectively equal to substantially four times the height of the tower and substantially twice the height of the tower and the third excitation loop 7*c* is situated substantially at the mid-height of the tower, corresponding to a current peak, in order to excite emission at a half wavelength λc/2 substantially less than the height of the tower.

Figure 16:
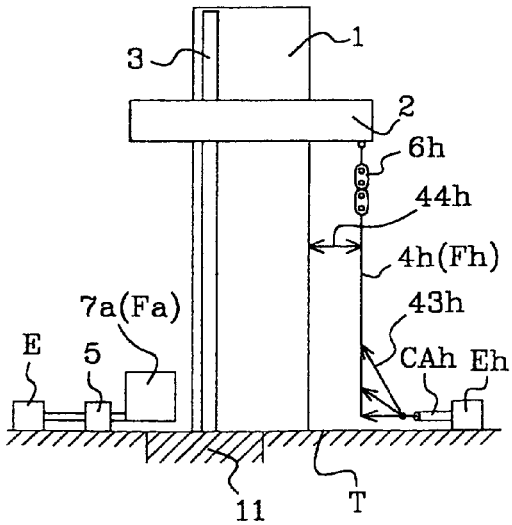
FIG. 16 is a diagrammatic vertical view of an electrically and magnetically coupled antenna combining a conductive excitation wire as in the first embodiment and a conductive excitation loop as in the second embodiment.

The tower 1 shown in FIG. 16 radiates signals at different frequencies Fa and Fh resulting from mixed coupling, firstly electrical coupling with a conductive excitation wire according to the first embodiment of the invention, such as the wire 4*a* shown in FIG. 7, and secondly magnetic coupling with an excitation loop 7*a* according to the second embodiment of the invention shown in FIG. 14.

The invention is not limited to using an existing broadcast tower as the structure for radiating substantially hectometric waves by excitation of a substantially vertical conductive wire or an excitation loop. Other existing structures, generally comprising a plurality of conductive members connected to ground, may serve as radiating structure. For example, this kind of structure may be an existing pylon, a water tower or a raised tank, a lighthouse or an offshore buoy, a lamp standard or a metal mast supporting spotlights in particular.

FIGS. 17 to 22 show diagrammatically and by way of non-limiting example the use of at least part of existing vertical structures to provide a emission antenna according to the invention.

FIG. 17 shows an existing inclined stay 4*a* for a tower 1. The lower end 41*a* of the stay is connected to an impedance matching cell 5. The upper end 42*a* of the stay is connected by an insulated tensioner 6 to constitute a conductive excitation wire of the type shown in FIG. 1.

FIG. 18 shows a folded dipole antenna as shown in FIG. 2 using an existing metal stay 4*b* of a tower 1; the stay 4*b* has a lower end 41*b* connected to an impedance matching cell 5 and an upper end 42*b* connected to an internal conductor 3 in the tower by a small conductive member 44*b* which has its ends welded to the stay 4*b* and to the internal conductor 3.

In FIG. 19, the existing tower is a metal truss tower 1M that has two existing stays 4*n* and 8 extending obliquely along the tower. The tower 1M is excited by mixed coupling of the type described with reference to FIG. 16 using a conductive excitation loop 7*a* situated at the base of the tower 1M and connected to an impedance matching cell 5*a* and a conductive excitation wire consisting of the stay 4*n*, whose upper end 42*n* is isolated and whose lower end 41*n* is connected to a matching cell 5*n*.

In the FIG. 19 embodiment, the second existing stay 8 constitutes, relative to an excited pilot radiating source consisting of the first stay 4*n*, an unwanted radiating source that is not excited. One end of the stay 8, for example the upper end 82, is isolated from the tower by means of an electrical insulator 84. The other end 81 of the stay 8, in this instance its lower end, is loaded by a reactor 83 connected to the ground T. According to whether the reactance of the reactor 83 is positive, and thus inductive, or negative, and thus capacitive, the stay 8 behaves as a reflector element or as a redirector element relative to the combination of the tower 1M and the excitation wire 4*n*. The supplementary gain conferred by the unwanted stay 8 may be from 1 dB to 3 dB. The FIG. 19 antenna has an azimuth diagram in which the radiated field is reduced in a particular direction in front of or behind the unwanted stay 8 and increased in a direction opposite to that particular direction.

Figure 20:
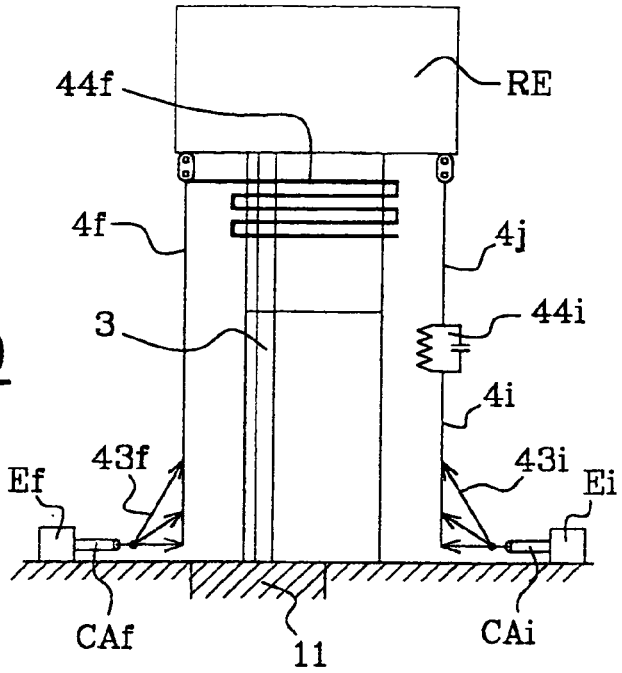

FIG. 20 shows an existing water tower or raised tank structure RE that is used to fix a conductive excitation wire 4*f* to the terminating capacitor 44*f* around the tower structure RE, in a combination of the variants shown in FIGS. 6 and 9, and a dual frequency conductive excitation wire 4*i*–4*j* with an intermediate blocking circuit 44*i*, as shown in FIG. 8. When of metal, the water distribution network connected to the water tower advantageously constitutes a grounding network that further improves the efficiency of the antenna in inverse proportion to the height of the water tower.

Figure 21:
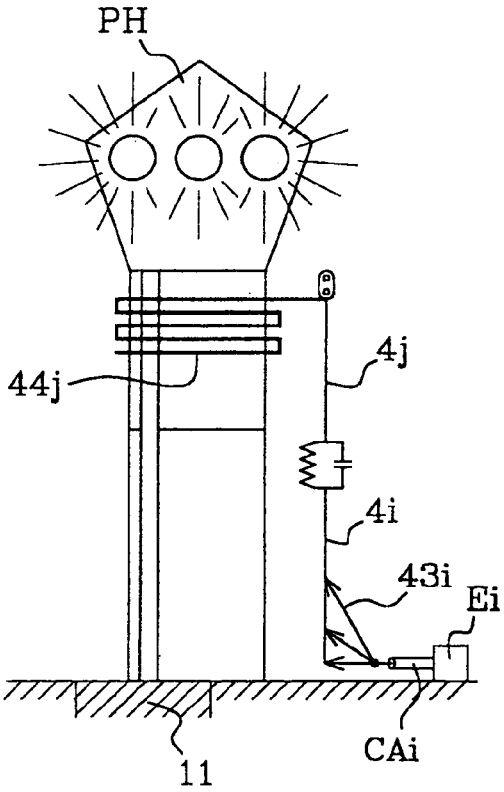

FIG. 21 shows an existing lighthouse or offshore buoy structure along which is installed a dual frequency excitation conductive wire 4*i*–4*j* with a terminating capacitor 44*j* surrounding an upper portion of the lighthouse, as shown in FIG. 9. Here the grounding network 11 comprises the sea, constituting an excellent conductor and favouring excellent propagation of emission signals to coastal towns.

Figure 22:
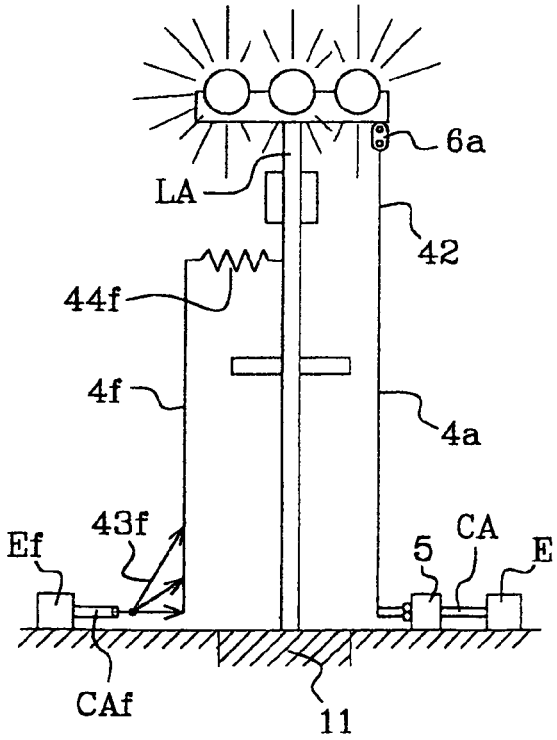

In FIG. 22, the existing structure is a lighting mast or lamp standard LA supporting a plurality of spotlights. Along the mast or lamp standard there are disposed a first conductive excitation wire 4*f* whose upper end is terminated by a load 44*f* connected to the mast or lamp standard LA and whose lower end is adjustable in height by means of a conductor 43*f*, as shown in FIG. 6, and a second conductive excitation wire 4*a* whose lower end 41*a* is connected to an impedance matching cell 5 and whose upper end 42 is connected under an upper spotlight support by an insulator 6*a*. Mast of this kind is already installed in a stadium, a fairground, a road or rail interchanges, a near large square, etc.

The invention claimed is:

1. An antenna for emitting substantially hectometric waves, said antenna comprising an existing vertical structure having a height of at least approximately 10 meters and including at least one electrically conductive member connected to ground, and an essentially electrically conductive electromagnetic excitation wire arrangement disposed at least in part in the vicinity of and outside the structure and connected to an emitter for causing said structure to radiate substantially hectometric waves.

2. An antenna according to claim 1, wherein the electromagnetic excitation wire arrangement comprises a conductive excitation wire substantially extending at least partly outside and along the structure.

3. An antenna according to claim 2, wherein the conductive wire has a first end connected to the emitter via an impedance matching arrangement situated substantially in front of the base of the structure and a second end fixed to the structure.

4. An antenna according to claim 3, comprising a grounding network including conductive wires or strips disposed in a star arrangement and connected to the matching arrangement.

5. An antenna according to claim 2, wherein a first end of the excitation wire is connected to the emitter via an impedance matching arrangement including a variable length conductor.

6. An antenna according to claim 2, wherein one end of the excitation wire is fixed to the structure via an electrical insulator.

7. An antenna according to claim 2, wherein one end of the excitation wire is connected to the conductive member of the structure.

8. An antenna according to claim 2, wherein one end of the excitation wire is connected to the structure via an impedance matching arrangement including a conductor movable along the conductive wire.

9. An antenna according to claim 2, wherein one end of the conductive wire is connected to the conductive member of the structure through a load.

10. An antenna according to claim 2, wherein one end of the excitation wire is connected to a terminating capacitive load consisting of turns of conductive wire around the structure.

11. An antenna according to claim 2, wherein one end of the excitation wire is fixed to the structure through an insulator and supports one or more deployed conductive wires.

12. An antenna according to claim 2, further including a coaxial terminating capacitor coupled with the antenna, the coaxial terminating capacitor including a first portion of the excitation wire extending along the structure and a second portion of the excitation wire extending in a conductive sheath situated inside the structure, the second portion of the excitation wire having a length substantially equal to that of the first portion of the excitation wire.

13. An antenna according to claim 2, wherein the excitation wire comprises two wires in line with each other and separated by a band-pass filter.

14. An antenna according to claim 2, wherein the excitation wire comprises two aligned conductive excitation wires running along the structure and having near ends connected by an insulator and connected to be fed by the emitter through a power balancer.

15. An antenna according to claim 1, wherein the electromagnetic excitation wire arrangement comprises a plurality of conductive excitation wires for different frequency bands and substantially extends at least partly outside and along said structure.

16. An antenna according to claim 1, comprising a non-excited wire arrangement disposed substantially along the structure and having one end isolated from the structure and another end loaded by a reactor connected to said ground.

17. An antenna for emitting substantially hectometric waves, the antenna comprising an existing vertical structure having a height of at least approximately 10 meters and including at least one electrically conductive member connected to ground, and a conductive electromagnetic excitation loop (7*a*) situated above the ground and outside and near the structure and connected to an emitter for causing the structure to radiate substantially hectometric waves.

18. An antenna according to claim 17, wherein the conductive electromagnetic excitation loop extends in a substantially vertical plane and has one side substantially parallel to the structure.

19. An antenna according to claim 17, wherein the conductive electromagnetic excitation loop is situated substantially at the level of the base or the middle of the structure.

20. An antenna according to claim 17, wherein the excitation loop (7*a*) has a perimeter of a few meters.

21. An antenna according to claim 17, further including a plurality of conductive loops for different frequency bands situated above the ground and outside and near the structure.

22. An antenna for emitting substantially hectometric waves, said antenna comprising an existing vertical structure having a height of at least approximately 10 meters and including at least one electrically conductive member connected to ground, and a conductive electromagnetic exciting tube substantially extending at least partly outside and along said structure and connected to an emitter for causing the structure to radiate substantially hectometric waves.

23. An antenna for emitting substantially hectometric waves, the antenna comprising an existing vertical structure having a height of at least approximately 10 meters and including at least one electrically conductive member connected to ground, and an electromagnetic excitation cage including a plurality of parallel conductive wires substantially extending at least partly outside and along the structure and connected to an emitter for causing the structure to radiate substantially hectometric waves.

* * * * *